US010605002B2

(12) United States Patent
Underwood et al.

(10) Patent No.: US 10,605,002 B2
(45) Date of Patent: Mar. 31, 2020

(54) LADDER CARRYING DEVICE

(71) Applicants: Richard Underwood, Grand Prairie, TX (US); Robert Eisenbeck, Garland, TX (US)

(72) Inventors: Richard Underwood, Grand Prairie, TX (US); Robert Eisenbeck, Garland, TX (US)

( * ) Notice: Subject to any disclaimer, the term of this patent is extended or adjusted under 35 U.S.C. 154(b) by 168 days.

(21) Appl. No.: 15/732,658

(22) Filed: Dec. 11, 2017

(65) Prior Publication Data

US 2018/0171713 A1 Jun. 21, 2018

Related U.S. Application Data

(60) Provisional application No. 62/498,102, filed on Dec. 15, 2016.

(51) Int. Cl.
*E06C 7/00* (2006.01)
*E06C 1/16* (2006.01)

(52) U.S. Cl.
CPC . *E06C 7/00* (2013.01); *E06C 1/16* (2013.01)

(58) Field of Classification Search
CPC ..... E06C 1/16; E06C 7/00; E06C 7/08; E06C 7/081; E06C 7/181; E06C 7/182; E06C 7/183; E06C 7/48; E06C 7/482; E06C 7/484; E06C 7/486; E06C 7/488; Y10T 16/466; Y10T 16/471
USPC ..... 182/129; 224/264, 265, 270, 907; 29/428
See application file for complete search history.

(56) References Cited

U.S. PATENT DOCUMENTS

| | | | | |
|---|---|---|---|---|
| 4,754,858 | A | 7/1988 | Robinson | |
| 4,770,272 | A * | 9/1988 | Riley | E04D 15/00 182/106 |
| 5,058,789 | A * | 10/1991 | Piper | B65G 7/12 224/265 |
| 5,207,364 | A * | 5/1993 | Johnson | B65G 7/12 224/264 |
| 5,511,285 | A | 4/1996 | Bush et al. | |
| 6,189,752 | B1 | 2/2001 | Perry | |
| 6,415,890 | B1 * | 7/2002 | Tucker | A47B 95/043 182/129 |
| 7,789,198 | B2 * | 9/2010 | Myers | E06C 7/50 182/129 |
| 7,849,963 | B1 * | 12/2010 | D'Agostino | A45F 3/14 182/129 |
| 8,322,491 | B2 * | 12/2012 | Crampton | E06C 7/00 182/129 |
| 9,890,589 | B2 * | 2/2018 | Goodnow | E06C 7/16 |
| 10,352,098 | B2 * | 7/2019 | Frensley | E06C 7/165 |
| 2002/0046904 | A1 * | 4/2002 | Richard | E06C 1/39 182/129 |

(Continued)

*Primary Examiner* — Joshua E Rodden
(74) *Attorney, Agent, or Firm* — Bakos & Kritzer

(57) ABSTRACT

A semi-cylindrical tubular component with grip component used to carry a ladder distributes the load supported by the user's hand. The ladder carrier device and process increase the contact area of the open longitudinal end or the flat u-channel, of the grip, with the ladder rung or side rails, resulting in a more evenly distributed load. The grip device can be used on both ladder rung and ladder leg supported with tension only, and accommodates hands of a plurality of human operators, and more than one user at a time. Additionally, the ladder may be carried either vertically or horizontally.

4 Claims, 10 Drawing Sheets

(56) References Cited

U.S. PATENT DOCUMENTS

| | | | | |
|---|---|---|---|---|
| 2002/0179657 | A1* | 12/2002 | Ladd | A45F 3/12 224/264 |
| 2002/0189902 | A1* | 12/2002 | Nelson | E06C 7/00 182/129 |
| 2003/0047574 | A1* | 3/2003 | Homeman | A45F 3/12 224/264 |
| 2007/0074932 | A1* | 4/2007 | Mutscheller | E06C 7/00 182/107 |
| 2008/0011547 | A1* | 1/2008 | Bonitto | E06C 7/00 182/129 |
| 2010/0263189 | A1* | 10/2010 | Lanzafame | E06C 7/00 29/428 |
| 2015/0083521 | A1* | 3/2015 | Foddrill | E06C 7/00 182/129 |
| 2016/0025244 | A1* | 1/2016 | Tally | H02G 3/32 248/72 |
| 2018/0171713 | A1* | 6/2018 | Eienbeck | E06C 7/00 |
| 2019/0218860 | A1* | 7/2019 | Seabold | E06C 7/46 |

* cited by examiner

LADDER CARRYING DEVICE

CROSS REFERENCE TO RELATED APPLICATIONS

This application claims the benefit of U.S. Patent App. No. 62/498,102, filed Dec. 15, 2016 and the foregoing application is incorporated by reference herein in its entirety.

TECHNICAL FIELD

The present disclosure relates to a releasable, flexible cylindrical ladder accessory for carrying a ladder and more specifically to a ladder carrying device that carries ladders in a safe and ergonomic manner such that when the ladder carrying device is secured to a ladder by tensioning either under a rung of the ladder for vertical transport or tensioned to a side rail of a ladder for horizontal transport then the hand, wrist, and elbow support the ladder in the most comfortable ergonomic manner for carrying.

BACKGROUND

Ladders are often made using thin sheet metal or plastic side rails to decrease weight, though ladders can still be quite heavy. Moving the ladders between locations in tight places may require carrying the ladder in an upright vertical manner, gripping the rungs with the hand and lifting the ladder. Additionally, the ladder may be carried horizontally by gripping the side rails. The side rail edge contacts the hand along an edge line and much of the ladder's weight is supported along that line. This can be very uncomfortable and for people who work with ladders on a regular basis it can be a source of fatigue on the job. The same can be true for a vertical lift by hand. Much of the weight is dispersed across the hand with rung sides vertically loading the hand and wrist in an uncomfortable position. The weight and downward thrust of that weight creates hand disorders which account for fully one third of all injuries at work, one fourth of lost work time, and one fifth of permanent disabilities. The prevention of hand movements that may cause increasing damage or protracted injuries to the hand, wrist and elbow by grabbing, turning, or finger strikes should be minimized. It would be beneficial for the ladder carrying device to fit the hand with no sharp edges eliminating awkward hand and wrist positions by providing good hand to object coupling. Such coupling is defined as a comfortable grip in which the hand can be easily wrapped around the object.

Construction workers and other trade people, such as electricians, plumbers, painters and carpenters, often use a ladder in their daily work. To get a ladder from one location to another location, such construction workers or trade people typically carry the ladder on their shoulder, with their arm threaded through an opening between the steps or rungs of the ladder. This causes either one of the side rails, if the ladder is carried horizontally, or one of the steps, if the ladder is carried vertically, to rest on the user's shoulder.

Even clamping mechanisms attached to either the side rail or the rungs require a gripping motion that allows the ladder to be downwardly weighted on one hand, resulting in ladders being dragged. Heavier ladders cannot be dragged in this manner. The only reasonable solution is to lift the ladder from a standing position for vertical transport such that the hand can center the weight over lifting legs. Heavier ladders present bigger problems during lifting and transporting. Therefore it would be most beneficial to create a ladder lift device and carrying device such that ladders on their sides can be lifted to a more comfortable position by placing the hand over and under the ladder with a hand resting on a device holding the ladder.

SUMMARY

In general in one aspect the disclosure features a ladder carrying device that includes a releasable, flexible cylindrical ladder accessory for carrying a ladder in a safe and ergonomic manner being secured to a ladder by tension in either a horizontal or vertical position. The tension is created by flexing the fingers or hand about a semi-cylindrical component, such that the wings attached thereto extend outward and upward into the plurality of crevices formed by the intersection of the rung side slats with the rung top and the same flexing maneuver enabling a similar movement for side rail of the legs within the crevices formed by the intersection of the side slats and the side leg rails. The ladder is raised to a carrying position vertically or horizontally and the ladder accessory is secured to a ladder rail by tensioning the ladder carrying device under a rung during vertical ladder transport such that the device tensions within the crevices formed by the step rung and the step rung side rails. In another embodiment, a device is tensioned by forcing a u-channel into and between the crevice formed by the two opposing edges of the side rails of a ladder with the ladder slat or formed by the two opposing sides of a rung with the rung for use in an under rung position.

In some embodiments the dimensions are critical for proper functioning of the device and so that it retreats to a position that does not interfere with ladder use. The positioning of the device between the edges of the underside of one of the rungs of the ladder or to one of the side rails of the ladder in some particular embodiments is critical to ensure that the ergonomic handle is capable of remaining affixed in use by retaining tension.

Patents and publications related to ladder accessory and devices include US Patent Publications 20080011547; 20100263189; 20020046904; 20020189902; and U.S. Pat. Nos. 4,754,858; 5,207,364; 6,189,752; 5,511,285; and 5,058,789.

BRIEF DESCRIPTION OF THE DRAWINGS

The accompanying drawings, which are incorporated into and constitute a part of this specification, illustrate one or more embodiments of the present disclosure and, together with the detailed description, serve to explain the principles and implementations of this disclosure.

DETAILED DESCRIPTION

Figure 1:
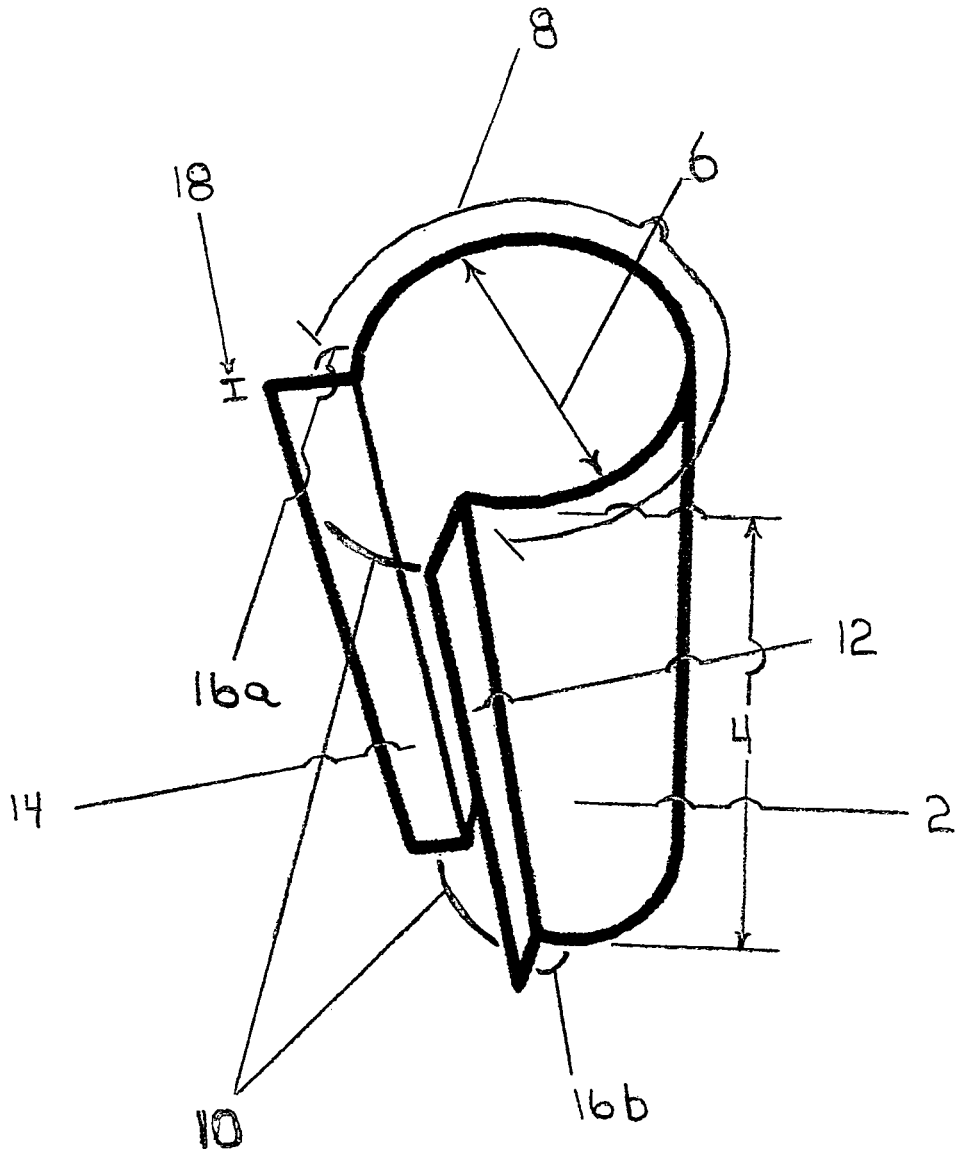
FIG. 1 depicts a cylinder as a cylindrical tube, opened on both ends with a longitudinal slit from one open end to another opposing open end with each of two edges formed having protruding flaps running longitudinally along the slit.

In the following detailed description, reference is made to the accompanying drawings which form a part hereof wherein like numerals designate like parts throughout, and in which are shown by way of illustration, specific embodiments of the present disclosure may be practiced. It is to be understood that other embodiments may be utilized and structural changes may be made without departing from the scope of the present discussion. Therefore, the following detailed description is not to be taken in a limiting sense, and the scope of the present disclosure is defined by the appended claims.

Reference in the specification to "one embodiment" or "an embodiment" means that a particular feature, structure, or characteristic described in connection with the embodiment is included in at least one embodiment. The appearance of "in one embodiment" in various places in the specification do not necessarily all refer to the same embodiment, but they may.

The description in the specification may use perspective based language such as upper surface/upper side, and lower surface/lower side or underside, front/back, top/bottom. Such language is merely used to facilitate the discussion, showing relative orientation and location of counterparts or components of the disclosure to one another and is not intended to restrict the application of the embodiments of the present disclosure to particular orientations.

Disclosed is a ladder lift device and method of lifting a ladder in at least three separate embodiments. The device can be executed in a plurality of forms. The ladder mounted transport mechanism provides a method of carrying a ladder comfortably without risk to hand, arm, wrist, or elbow. The disclosure provides a comfortable, stable, removably mounted device that can be moved to other ladder locations and affixed to any rung or side rail of the ladder. However, there are optimum placements of the device for various carrying positions and for heavier ladders. With the device mounted at a comfortable location on any rung or side rail, the ladder is carried with a hand grasped about the circumference of the device providing for maximum ergonomic comfort. The fingers of a hand flex the semi-cylindrical device's circumference with a longitudinal slit and a first protruding wing (sometimes referred to as flanges or flaps) and a second protruding wing along either side of the slit in a manner that flexes the circumference of the cylinder, slightly. This flexure of the cylinder causes protruding wings to flex outward and into a first crevice and a second crevice. Each crevice is either formed by the rung intersection with each of two rung side rails on the underside of the rung or by the intersection of the leg slat with each of two leg side rails. A similar motion to that needed to flex under the rung results in the first protruding wing and the second protruding wing flexing into one each of two crevices of the leg side rails. The cylinder with a first protruding wing is pushed into the crevices with a slight upward thrust of the hand on the cylindrical circumference. The embodiment with protruding wings is best used with older ladders where the rung tops are parallel to the ground. A flexing of a circumference of a cylinder enables two opposing protruding flaps to flex outward contacting the crevice of an under rung or a leg side rail.

A second embodiment is depicted as a semi-cylindrical tubular grip component atop a slanted U-beam channel tension component with the slanted U-beam channel tension component having a flat topped thrust plate with two separate sides. A first side plate depicted in the foreground with a second sided plate depicted in the background. The second side plate is slanted at an acute angle relative to the line (A to A') as drawn. The second side plate is slightly larger than the first side rail slat. The semi-cylindrical tubular grip component has a defined semi-cylindrical circumference of at least 2.5 inches but not more than 3.0 inches in most embodiments fitting within the palm of the user and or human operator. The embodiment in FIG. 4, can be thought of as the embodiment depicted in FIG. 1, FIG. 2, and FIG. 3 as the first protruding wing and the second protruding wing extended and folded together to form the slanted U-beam channel tension component and the flat topped thrust plate.

The embodiment with a flat U-beam channel is often used with more modern ladders where rung tops are slanted in relation to the ground (at a slightly acute angle) with a corresponding acute slant on one of two sides of the U-channel where the acute slant fits into and against the under rung of the ladder at the apex of the rung's slant such that the flat top of the U-channel is slanted downward in the same direction as the downward slant of the rung with approximately the same angle of slant.

A gripping action enables the slanted U-beam channel tension component at each of the two edges on opposite sides of the flat topped thrust plate to flex outward slightly. This slight outward motion along with an upward motion of the hand forces the device into and against the under rung of the ladder into crevices formed by the rung side rails on either side of the rung or each of two leg side rails allowing tension to hold the device in place until it is removed. The device can remain in place or easily be removed for storage upon cessation of use. Additionally, the cylindrical shape can be flattened somewhat.

In a third embodiment, a slanted U-beam channel tension component has a slit flat topped thrust plate where the slit has a height of at least 1.14 inches which determines heights for a first and a second side plate of the slanted U-beam channel tension component side slats. The slanted U-beam channel tension component flat topped thrust plate slit opening is 0.125 inches.

In FIG. 1, a cylinder 2, is described as having a length ranging from at least three (3) inches to at least ten (10) inches (L) 4, having a diameter 6, ranging in size from 2.5 inches to 3.0 inches with a diameter of 2.8 inches shown. The diameter 6, allows optimal carrying capacity with a human operator's hand given sufficient room to flex the circumference 8, of the cylinder 2, with two to three fingers opposing the thumb and flexing the hand and fingers, slightly. Cylinder 2, has a slit 10, running length-wise along its longitude, from a proximate end to a distal end mounted on a circumference 8, of the cylinder 2, with a first protruding wing 12, and a second protruding wing 14, both protruding at an approximate 90-degree angle (16*a* and 16*b*) from the outer wall, of the cylinder 2, with respect to a cylinder wall with a thickness of approximately 0.125 inches 18, and running longitudinally along the cylinder slit 10.

Figure 2:
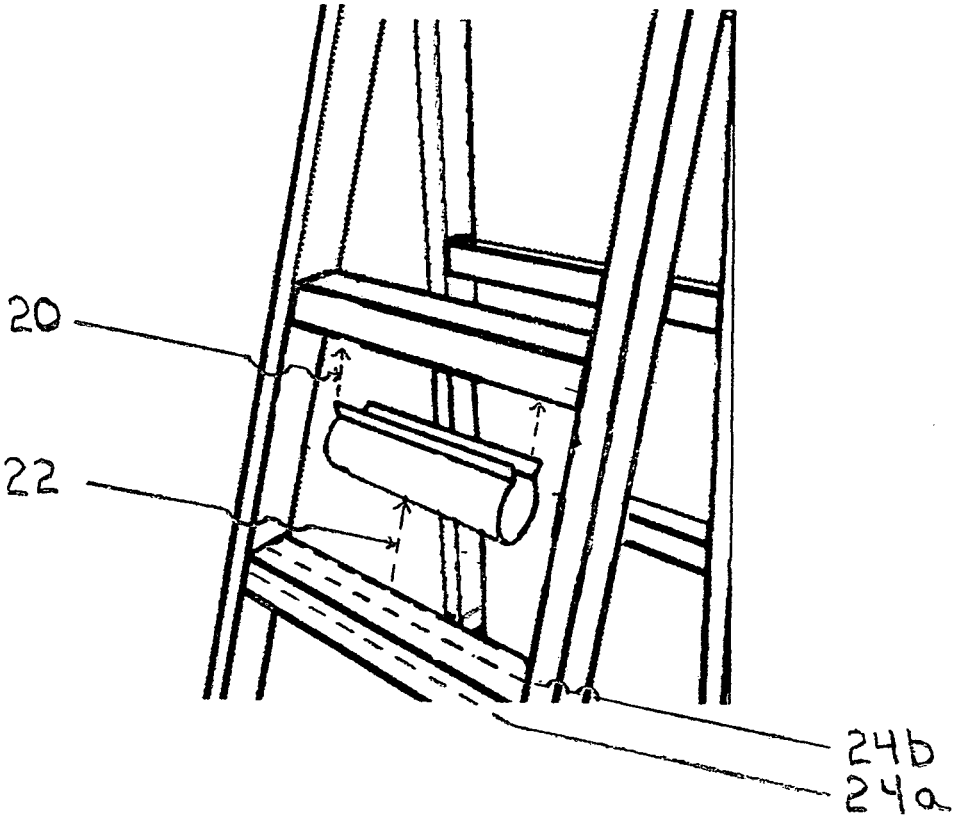
FIG. 2 depicts a perspective view of FIG. 1, a method describing how the cylinder in FIG. 1 may be affixed to the underside of a ladder rung.

In FIG. 2, the first protruding wing 12, and the second protruding wing 14, from FIG. 1, provides a means to create a tension depicted by the placement 20, of the cylinder 2, from FIG. 1, along with the upward thrusting motion 22, applied to the circumferential shape 8, of FIG. 1. Additionally, the upward thrusting motion 22, of a human operator's hand provides the force necessary to push the cylinder 2, into the crevices 24*a*, and 24*b*, of the ladder formed under the rung by a first side rail of the rung 25*a*, and a second side rail of the rung 25*b*, shown in FIG. 2.

Figure 3:
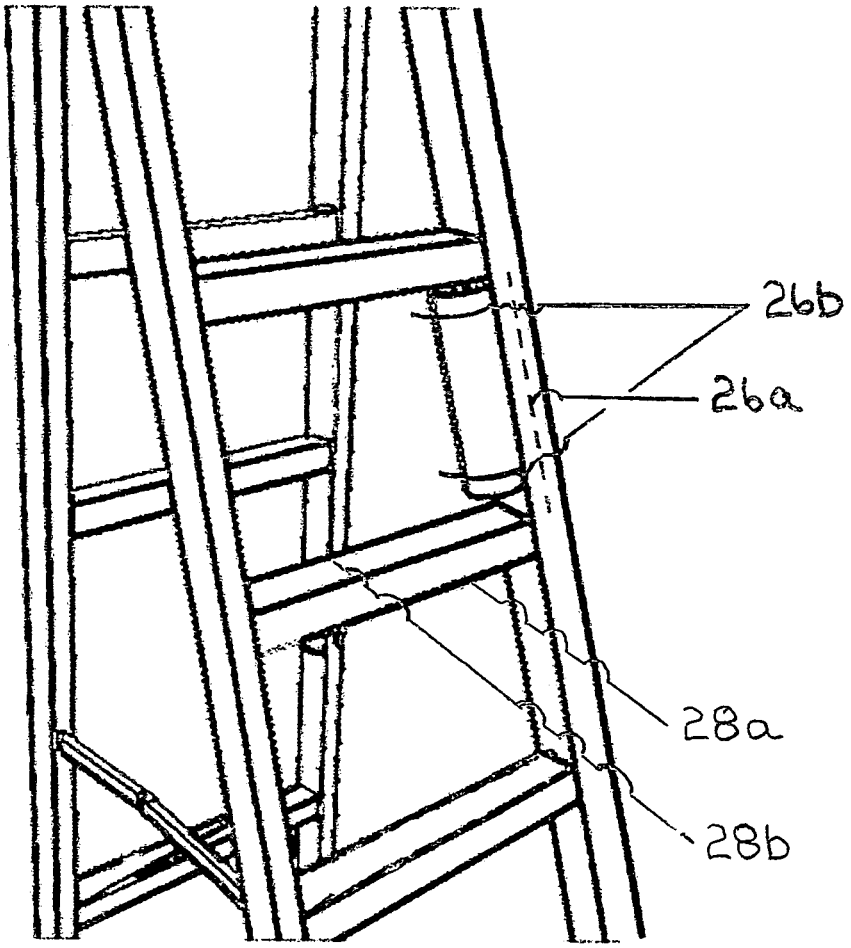
FIG. 3 depicts a perspective view of FIG. 1, affixed to the leg side rail.

In FIG. 3, a device is depicted as being affixed to the ladder legs with a dotted line 26*a*, of a first leg side rail of a ladder, and a dotted line of a second leg side rail of a ladder 26*b*, depicting the beginning of the bend of the 90-degree from each of the first protruding wing 12, and the second protruding wing 14, of cylinder 2, as denoted in FIG. 1. Additionally, a first leg crevice 28*a*, formed from the first leg side rail interconnection to an outward leg at 28*b*, formed from a second leg side rail interconnection to an outward leg slat on the leg side rail the dotted line location denotes where the first protruding wing 12, and the second protruding wing 14, from FIG. 1, are tensioned.

Figure 4:
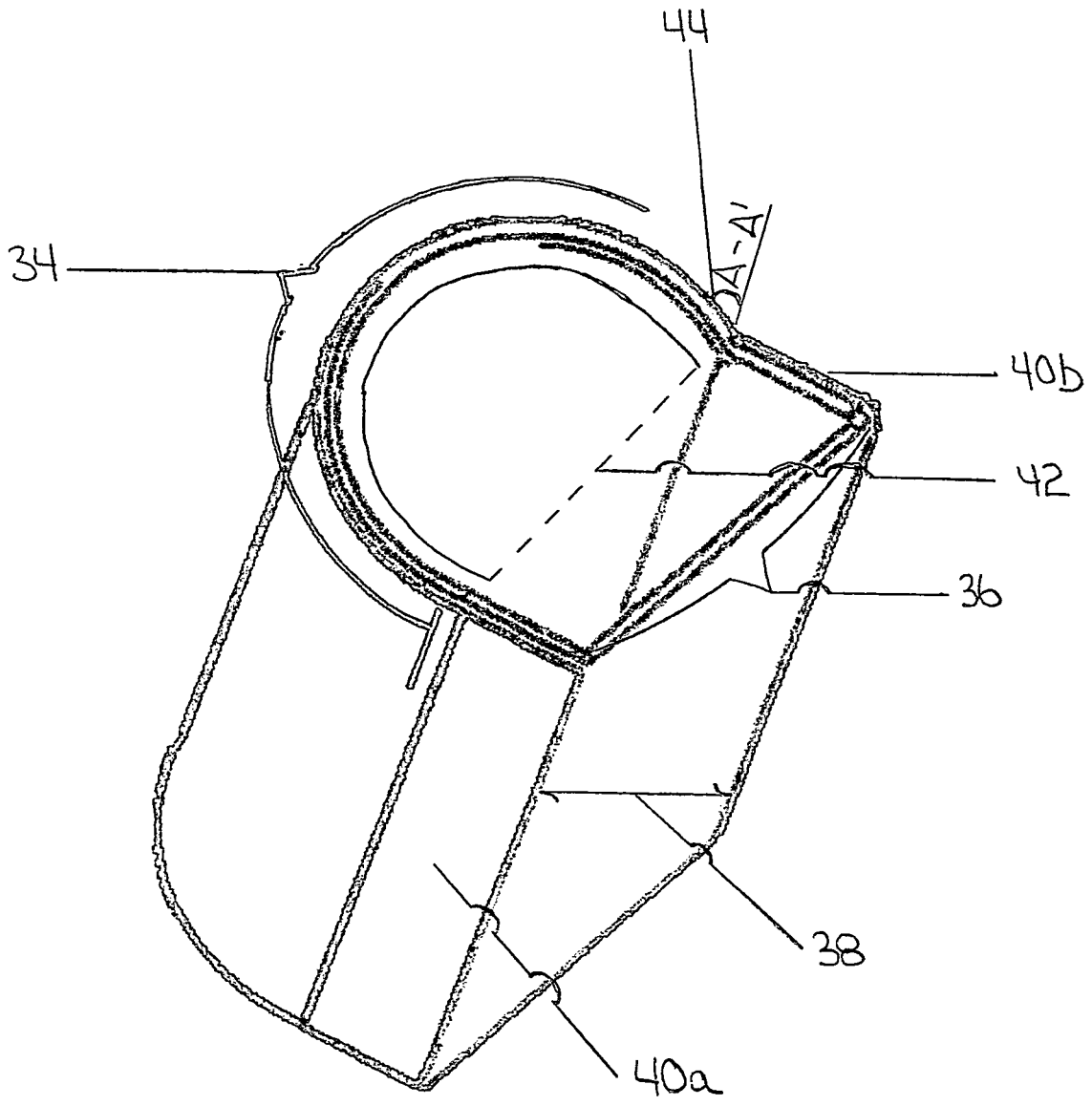
FIG. 4 depicts another embodiment as a semi-cylindrical tubular grip component mounted atop a slanted U-beam channel tension component. The slanted U-beam channel tension component has a flat topped thrust plate with two separate sides with one side in the foreground and a second side in the background.

In FIG. 4, a second embodiment is depicted as a semi-cylindrical tubular component 34, atop a slanted U-beam channel tension component 36. The slanted U-beam channel tension component 36, has a flat topped thrust plate 38, with two separate sides. A first side plate depicted in the foreground 40*a*, and a second sided plate depicted in the background as 40*b*. The second side plate 40*b*, is slanted at an acute angle 44, relative to the line (A to $A^1$) as drawn. 40*b*, the second side plate is slightly larger than 40*a*, the first side rail slat. The semi-cylindrical tubular grip component 34, has a defined semi-cylindrical circumference 42, of at least 2.5 inches but not more than 3.0 inches in most embodiments fitting within the palm of the user and or human operator. The embodiment in FIG. 4, can be thought of as the embodiment depicted in FIG. 1, FIG. 2, FIG. 3, and FIG. 4 as the first protruding wing 12, and the second protruding wing 14, extended and folded together to form the slanted U-beam channel tension component 36 and the flat topped thrust plate 38.

Figure 5:
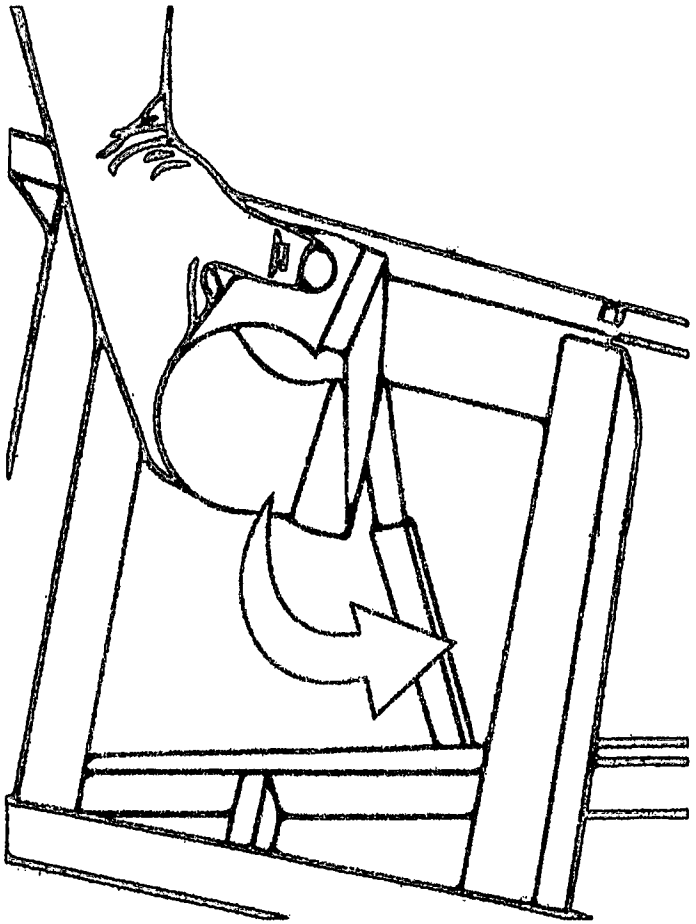
FIG. 5 depicts in a second embodiment how the cylindrical ½ tube is attached on a closed U-channel and how that second embodiment is fitted under rung in the same manner as the device in FIG. 2.

FIG. 5 depicts mounting of the device in FIG. 4 under the rung of a ladder.

Figure 6:
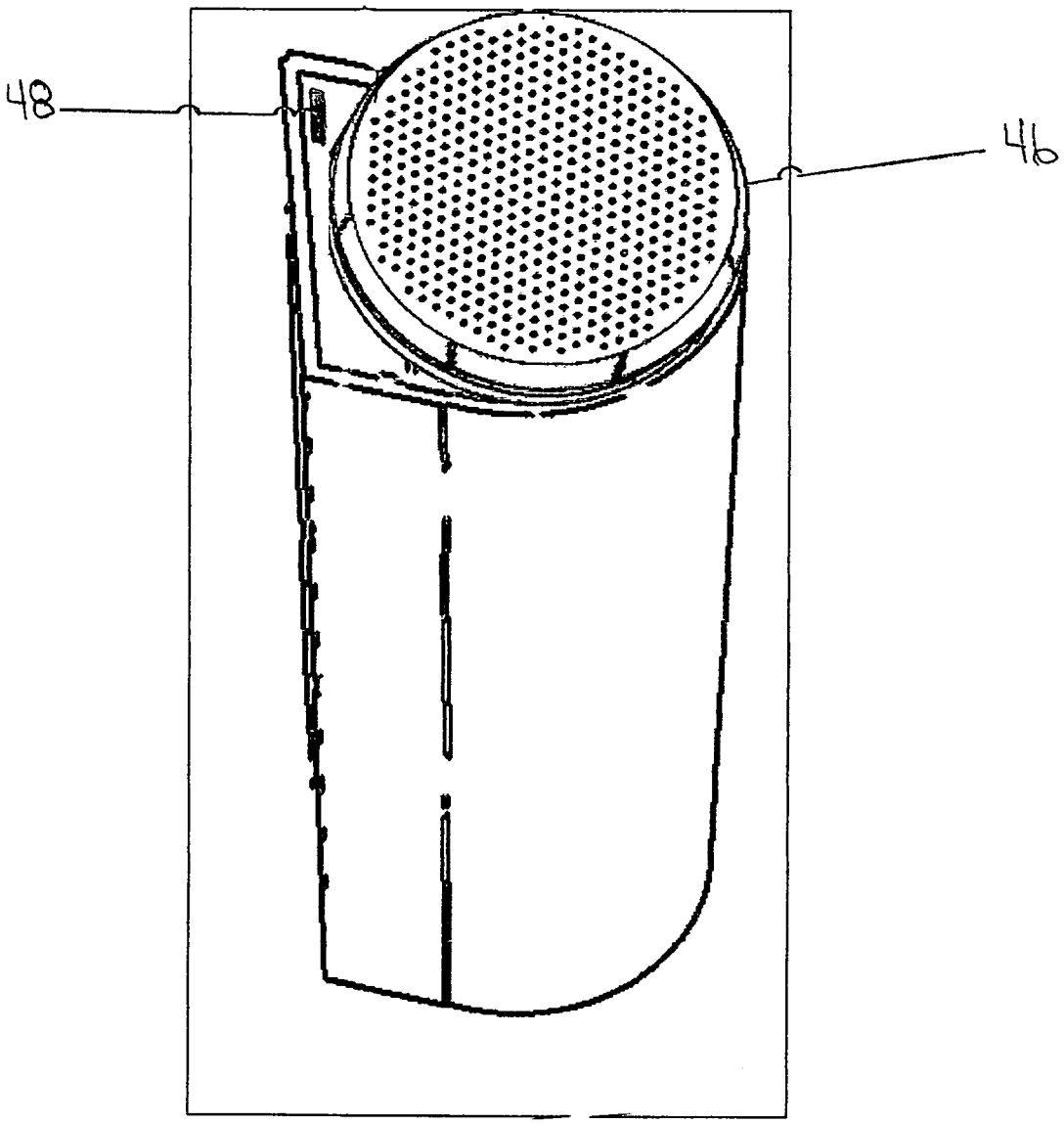
FIG. 6 depicts how the device in FIG. 5 can mount a speaker on at least one of two ends of the cylindrical tube and further how on the support for the speaker a USB port may be installed.

FIG. 6 depicts how a speaker 46, fits on at least one of two ends of the device depicted in FIG. 4, and the location of a USB port 48, for charging, communication and miscellaneous other functions.

Figure 7:
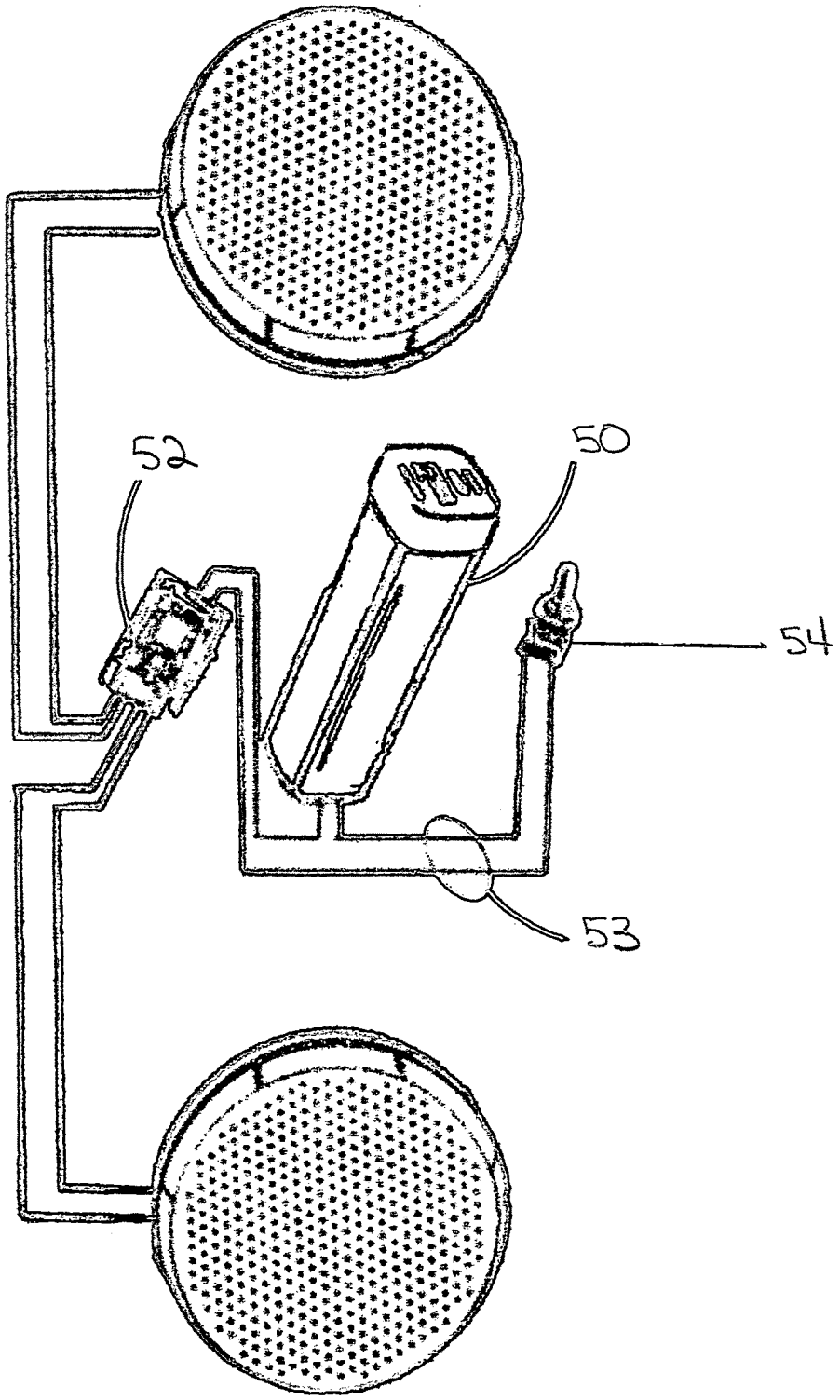
FIG. 7 depicts a wiring diagram for electronics attached to the USB port and at least one speaker (two shown) and switch mounted externally as well as internally mounted components including a Bluetooth wireless controller, battery charger, wiring for transmitting information from the battery charger and controller board, to the speakers, Bluetooth wireless controller.

FIG. 7 depicts at least one externally mounted switch 54, with an internally mounted Bluetooth wireless controller and battery charger 50, and controller board 52 with wiring 53, connecting therebetween the components named and the electric controls to the electric switch 54.

Figure 8A:
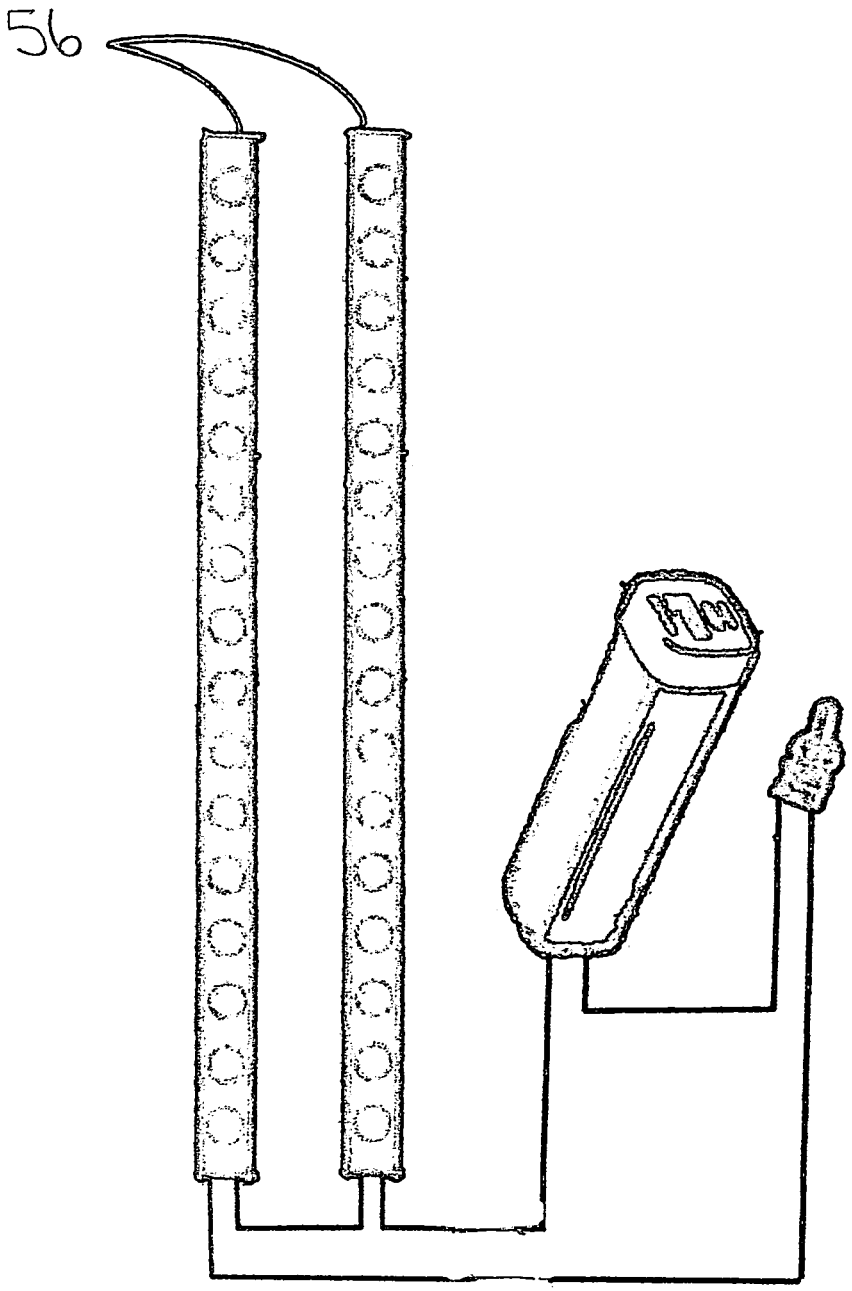
FIG. 8A depicts the lights to be mounted inside the semi-cylindrical tubular grip component mounted atop the slanted U-beam channel tension component from FIG. 4, along with the wiring denoting a connection to the Bluetooth wireless controller and battery charger as well as a switch. Additionally, the Bluetooth wireless controller and switch are depicted again for clarity.

FIG. 8A depicts lights 56, to be mounted inside the semi-cylindrical tubular grip component 34 mounted atop the slanted U-beam channel tension component 36, from FIG. 4, along with the wiring 53, showing connection to the Bluetooth wireless controller and battery charger 50, and the switch 54.

Figure 8B:
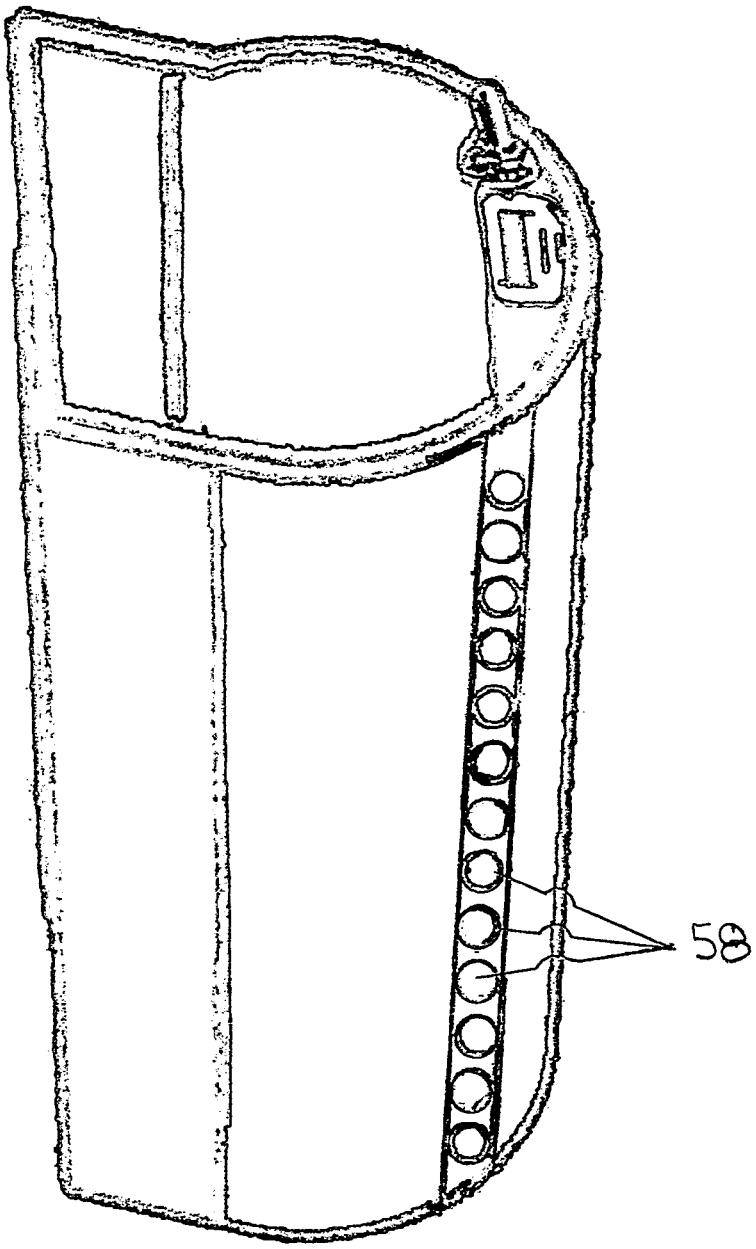
FIG. 8B depicts a set of internally mounted lights in openings of a cylinder and the switch from FIG. 8A.

FIG. 8B a set of internally mounted lights 56, mounted inside the device depicted in FIG. 4, along with openings 58, for the cylinder depicted in FIG. 4, and switch 54 from FIG. 8A.

Figure 9:
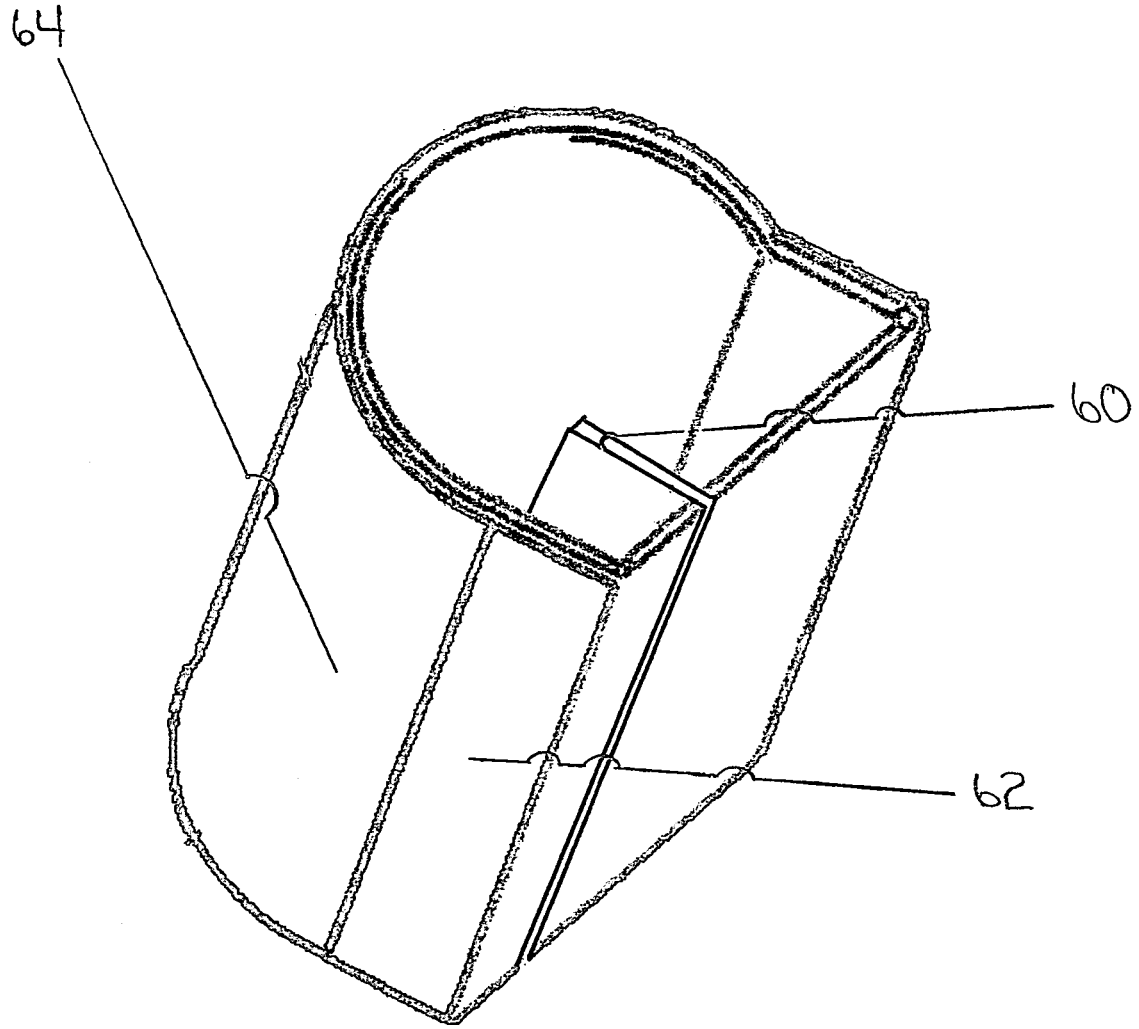
FIG. 9 depicts a third embodiment with a U-beam channel tension component with a slit flat topped thrust plate with sides of the thrust plate being of the same size as the slats of the slanted U-beam channel tension component.

FIG. 9 a third embodiment of the cylinder 64, with the sides of the flat topped thrust plate as 1.14 inches in dimension 62, with the slit 60, shown at the same length at the side plates the 1.14 inches.

In one embodiment a ladder lift system is described working with a ladder wherein the device includes a curved cylindrical surface cylinder 2, of FIG. 1, positioned to fit the user's hand from which a first flange (protruding wing) 12, protrudes from a first edge along a channel (slit) 10, of FIG. 1, of a curved surface with a circumference 8, of FIG. 1, with an angle of at least 90 degrees 16*a*, of FIG. 1, and a second flange (protruding wing) 14, of FIG. 1, protrudes from a second edge along the channel 10, of FIG. 1, of the curved surface (circumference) 8, with the angle of at least 90 degrees 16*b*, wherein the first flange (protruding wing) 12, of the first edge opposes the second flange (second protruding wing) 14, of the second edge of the curved surface 8, with a channel 10, positioned therebetween. A channel 10, parallel and co-extensive to the longitudinal axis of the curved surface 8, between the first flange 12, and the second flange 14, open to the first surface of the rung underside and may open to at least two ends disposed opposite one another on the distal and the proximate end of the channel. The first flange 12, of the first edge and the second flange 14, of the second edge are configured to mate with the rung underside, between two side rails of the ladder rung. Pressure on the curved surface causes the first flange 12, and the second flange 14, to flex outward resulting in flange 12, and flange 14, to move in opposition to one another outwardly from the longitudinal axis of the channel 10. The flange 12, and the flange 14, tension outward into at least two crevices denoted by 24*a*, and 24*b*, formed by the intersection of the rung and each of the side rails 25*a*, and 25*b*, that extend downward from the underside of a rung. The tensioning of the flange holds the ladder lift device in place.

In another embodiment, a flexible curved grip of circumference 8, with a longitudinal axis co-extensive with the channel 10, for transporting the ladder denoted by two end openings perpendicular to a longitudinal axis co-extensive with a channel 10, and a first flange 12, of a first edge of the first flange 12, of the longitudinal axis co-extensive with a channel 10, having a first contoured edge of a first flange 12. In the same embodiment, is a flexible curved grip of circumference 8, with a longitudinal axis coextensive with the channel 10, having a second contoured edge of the flange 14. The first flange 12, and the second flange 14, intersect the tubular circumference 8, at essentially a right angle, but not exactly perpendicular.

In another embodiment the invention relates to a thin walled tubular device with a thickness 18, of 0.125 having a longitudinal axis running along and co-extensive with the cylinder slit 10. The tubular device is split along the longitudinal axis forming a channel 10. Along a first edge of the channel 10, is a first flange 12, opening outward from the edge of the channel 10. Along a second an edge is supported by a second flange 14, opening outward from each edge of the flange 12, and 14. The channel 10, parallel and co-extensive to the longitudinal axis of the curved surface 6, between the first flange 12, and the second flange 14, and may open to at least two open ends disposed opposite one another on the distal and proximate end of the channel 10. The first flange 12, of the first edge and the second flange 14, of the second edge are configured to mate with a ladder rung underside or a ladder side rail. The tubular device 2, is rigid lengthwise but flexible around its circumference 8. So that a simple movement of the flexing of fingers results in a downward lateral movement of the circumference 8, of the tube causing the flanges 12, and 14, to swing open allowing the flanges 12, and 14, to point outward and catch the underside crevice 24*a*, and 24*b*, of the ladder under rung or the first crevice 30*a*, and second crevice 30*b*, of the ladder side rail.

In another embodiment, the ladder transport mechanism for transporting a ladder intersects a first side rail and a second side rail, wherein the first and the second side rails each have an inner surface and an outer surface and wherein the first and the second side rails inner surfaces are connected by a plurality of rungs therebetween and having an upper surface and under surface of each rung with side rails attached to each under surface of each rung with a first crevice 30*a*, and a second crevice 30*b*, formed from the intersection of the first side rail and the underside of the rung and the intersection of the second side rail and the underside of the rung, wherein the embodiment has a thin walled thickness of 0.125 inches 18, a tubular mechanism having a longitudinal axis co-extensive with a slit 10, and the tubular mechanism is split along the longitudinal axis forming a slit 10, and along a first edge of the slit 10, is a first flange 12, opening outward from the first edge of the slit 10, along a first side of the slit 10; and has a second edge of the slit 10, is a second flange 14, opening outward from the second edge of the slit 10, along a second side of the slit 10; with a first edge of the first flange 12 intersecting the first crevice 25*a*, and with a second edge of the second flange 14, intersecting the second crevice 25*b*.

The ladder transport mechanism has in one instance a thin walled 0.125 inch 18, tubular device that is composed of metal and in many cases aluminum.

The ladder transport mechanism has in another instance the thin walled tubular device being at least 2.5 inches in diameter but no more than 3.0 inches in diameter.

The ladder transport mechanism has in another instance the thin walled tubular device being composed of plastic The ladder transport mechanism has in another instance the thin walled 0.125 inches 18, tubular device that is at least 10 inches in length.

In another embodiment, there is a slit tubular device having a tubular component which has two opposing ends parallel to one another and a continuous boundary wall forming in the first instance an outer wall and in the second instance an inner wall, simultaneously, the tubular component formed of a flexible material and the two parallel ends wherein the tubular device behaves in a flexing spring-like motion.

Additionally, there is a continuous longitudinal slit formed along the tubular component, the longitudinal slit defining a first continuous longitudinal edge and second continuous longitudinal edge, the first and the second continuous longitudinal edges having flaps 12, and 14, which extend and diverge outward from the first continuous longitudinal edge and the second continuous longitudinal edge, wherein a first continuous longitudinal edge flap or wing 12, and a second continuous longitudinal edge flap or wing 14, diverge when the tubular component is circumferentially flexed.

In another embodiment, there is a process for comfortably carrying a ladder having the steps of obtaining a flexible, releasable semi-cylindrical tube 2, with slit 10, of the tubular device having two ends and a continuous boundary wall, the tubular component or cylinder 2, being formed of a flexible material and continuous longitudinal edges permitting the flaps 12, and 14, to behave in a spring like manner, which flexes outward upon pressure applied to the circumference 8, of the cylindrical tube 2.

Additionally, there is a continuous longitudinal slit 10, formed along the length of the tubular device 2, where the longitudinal slit 10, defines a first continuous longitudinal edge with the flap 12, and a second continuous longitudinal edge with the flap 14, which extend and diverge outward from the first continuous longitudinal edge and the second continuous longitudinal edge, and a first continuous longitudinal edge flap 12, and a second continuous longitudinal edge flap 14, diverge when the tubular device 2, is circumferentially flexed.

There is a slit 10, of a tubular device 2, having flexing flaps with a first flap of 12, and a second flap 14, diverging outward from the first and second continuous longitudinal edges with a curving circumference 8, and diameter 6, wherein the circumference that is at least 2.6 inches and no more than 2.9 inches, and the length of the slit tubular device is at least 10 inches, with the angle 16*a* for the first flap and an angle 16*b*, along the longitudinal edge being about 90 degrees and with the thickness 18, of the boundary wall being about 0.125 inches.

There is another embodiment that is a tubular mechanism that is fitted along its longitudinal axis with a slanted U-beam channel tension component 36. The flat topped thrust plate 38, of the U-beam channel tension component 36. A first side plate depicted in the foreground as 40*a*, and a second side plate depicted in the background as 40*b* where the two side plates 40*a*, and 40*b*, are equal in dimension, but 40*b* is slanted at an acute angle relative to the line depicted in FIG. 5, as A-A'. The semi-cylindrical tubular grip component 34, and the slanted U-beam channel tension component 36, are fitted together in one of two ways. Either the slanted U-beam channel tension component 36, is mounted directly to the outside of the semi-cylindrical tubular grip component 34, with a defined circumference 42, of 2.8 inches with no slit. Secondly, the slanted U-beam channel tension component 36, is mounted directly to the outside of the semi-cylindrical tubular grip component 34, opening positioned directly under the slanted U-beam channel tension component 36, such that the side rails of the rungs of the slanted U-beam channel tension component 36, and the opening of the slanted U-Beam tension component are coupled. One side of the thrust plate 38, of slanted U-beam channel tension component 36, is slanted such that an acute angle is created at the intersection of the flat top thrust plate 38, of the slanted U-beam channel tension component 36, and a first side rail and an slightly obtuse angle is created by the intersection of the flat top thrust plate 38, at the intersection of a second side rail.

Another embodiment is a ladder transport mechanism for transporting a ladder having a first side rail and a second side rail, wherein the first and the second side rails each have an inner surface and an outer surface and wherein the first and the second side rails inner surfaces are connected by a plurality of rungs therebetween and having an upper surface and under surface of each rung with side rails attached to each under surface of each rung with a first crevice 24*a*, and a second crevice 24*b*, formed from the intersection of a first side rail and the underside of the rung and the intersection of a second side rail of the rung and the underside of the rung, having a wall thickness 18, of 0.125 inches wherein the tubular cylinder 2, encloses a tubular space of 2.5 inches in diameter along a continuous longitudinal axis extending about 10 inches. This embodiment has a slanted U-beam channel tension component 36, extending along and attached to the external diameter of the tubular cylinder 2, wherein the slanted U-beam channel tension component 36, opens facing the tubular mechanism and is attached thereto and wherein a first side rail of the channel forms an acute angle between the first side rail and the flat topped thrust plate 38, of the slanted U-beam channel tension component 36. Additionally, there is a second side rail of the slanted U-beam 36, that forms an obtuse angle between the second side rail and the flat topped thrust plate 38, of the slanted U-beam channel tension component 36, with a first edge formed by the intersection of the first side rail and the flat topped thrust plate 38, of the slanted U-beam 36, that intersects the first crevice 24*a*, of the under rung and with a second edge formed by the intersection of the second side rail and the flat topped thrust plate of the slanted U-beam channel tension component 36, intersects the second crevice 24*b* of the underside of the rung.

Another embodiment is a ladder carrying device for transporting a ladder having a first side rail and a second side rail, wherein the first and the second side rails each have an inner surface and an outer surface and wherein the first and the second side rails inner surfaces are connected by a plurality of rungs therebetween and having an upper surface and under surface of each rung with side rails attached to each under surface of each rung with a first crevice 24*a*, and a second crevice 24*b*, formed from the intersection of a first side rail and the underside of the rung and the intersection of a second side rail of the rung and the underside of the rung, having a thin walled tubular mechanism with a wall thickness 18, in inches of at least 0.125 inches thick having a longitudinal axis and wherein the tubular mechanism encloses a tubular space at least 2.5 inches in diameter but no more than 3.0 inches in diameter along a continuous longitudinal axis extending about 8 inches. This embodiment also has a channel U-beam extending along and attached to the external diameter of the tubular mechanism and wherein the channel U-beam opens facing the tubular mechanism and is attached thereto and wherein a first side rail of the slanted U-beam channel component forms an acute angle between the first side rail and the flat topped of the thrust plate. And also, wherein a second side rail of the channel U-beam channel component forms an obtuse angle between the second side rail and the flat top of the slanted U-beam channel component (U-beam) has a first edge formed by the intersection of the first side rail and the flat topped thrust plate of the U-beam intersects the first crevice of the under rung and has a second edge formed by the intersection of the second side rail and the flat top of the channel U-beam intersects the second crevice of the under rung. And additionally, a channel opens under the channel U-beam where a first channel edge meets a first channel U-beam edge; and has a second channel edge meets a second channel U-beam edge. This same embodiment can be mounted to a side rail of the legs of a ladder.

Another embodiment is depicted in FIG. 9, where a semi-cylindrical tubular grip component 64, with the sides 62, of the flat topped thrust plate 38, from FIG. 4, with a slit 60 shown attached to a slanted U-beam channel component 36, from FIG. 4, with side slats being 1.14 inches 62, with the slit 60, shown at the same length and height as the side plates being 1.14 inches. The side slats in FIG. 9, are the same height with the slit providing additional structural support.

Another embodiment denoting a ladder transport mechanism for transporting the ladder having a first side rail and a second side rail, where the first and the second side rails each have an inner surface and an outer surface and where the first and the second side rails inner surfaces are connected by a plurality of rungs and having an upper surface and under surface of each rung with side rails attached to each under surface of each rung. Where the ladder transport mechanism has a thin walled tubular mechanism with a longitudinal axis where the tubular mechanism is split along the longitudinal axis forming a slit where a first edge of the slit is attached to a first flange opening outward from the first edge of the slit along a first side of the split where a second edge of the slit is attached to a second flange opening outward from the second edge of the slit along a second side of the split. Where a first crevice is formed from the intersection of the first side rail and the underside of the rung intersecting the first crevice and where a second crevice is formed from the intersection of the second side rail of the rung and the underside of the rung intersecting the second crevice.

In another embodiment there is described a slit tubular device having a tubular component with two opposing ends parallel to one another and a continuous boundary wall forming in a first instance an outer wall and in a second instance an inner wall, simultaneously, with the tubular device being formed of a flexible material enabling the tubular device to behave in a flexing spring-like motion. There exists a continuous longitudinal slit formed along the tubular component where the continuous longitudinal slit defines a first continuous longitudinal edge having flaps which extend and diverge outward from the first continuous longitudinal edge where the first continuous longitudinal edge flap diverges when the tubular component is circumferentially flexed. Additionally, there exists a continuous longitudinal slit formed along the tubular component where the continuous longitudinal slit defines a second continuous longitudinal edge having flaps which extend and diverge outward from the second continuous longitudinal edge and where the second continuous longitudinal edge flap diverges when the tubular component is circumferentially flexed. There is also a channel defined by the continuous boundary and accessible from the two ends or through the continuous longitudinal slit.

A method of comfortably carrying a ladder having the steps of obtaining a spring like slit tubular device where a tubular device has two ends and a continuous boundary wall, a tubular component being formed of a flexible material and continuous longitudinal edges enable flaps to behave in a spring like manner. Additionally, there is a continuous longitudinal slit formed along the length of the tubular device which defines a first continuous longitudinal edge with a second continuous longitudinal edge having a first flap along the first continuous longitudinal edge with a second flap along a second continuous longitudinal edge which extends and diverges outward from the first continuous longitudinal edge and the second continuous longitudinal edge when the tubular device is circumferentially flexed.

The spring like slit tubular device is further defined as having flexing flaps diverging outward from the first and second continuous longitudinal edges where the curve diameter is at least 2.6 inches and no more than 2.9 inches and where the length of the slit tubular device is no more than 10 inches. Additionally, the angle of the flap with the longitudinal edge is about 90 degrees and the slit tubular device has the thickness of the boundary wall being about 0.125 inches.

A ladder transport mechanism for transporting a ladder having a first side rail and a second side rail, where the first and the second side rails each have an inner surface and an outer surface and where the first and the second side rails inner surfaces are connected by a plurality of rungs each having an upper surface and under surface with side rails attached to each under surface of each rung with a first crevice and a second crevice formed from the intersection of a first side rail and the underside of the rung and the intersection of a second side rail of the rung and the underside of the rung.

Also there is a thin walled tubular mechanism with a wall thickness at least 0.125 inches thick which has a longitudinal axis where the tubular mechanism encloses a tubular space at least 2.5 inches in diameter but no more than 3.0 inches in diameter along a continuous longitudinal axis extending from 8 inches to no more than 10 inches.

The mechanism has channel U-beam extending along and attached to the external diameter of the tubular mechanism where the channel U-beam opens facing the tubular mechanism and is attached to it there.

The mechanism has a first side rail of the channel that forms an acute angle between the first side rail and the flat top of the channel U-beam and a second side rail of the channel that forms an obtuse angle between the second side rail and the flat top of the channel U-beam.

There is a first edge formed by the intersection of the first side rail and the flat top of the channel U-beam intersects the first crevice of the under rung with a second edge formed by the intersection of the second side rail and the flat top of the channel U-beam intersects the second crevice of the under rung.

A ladder transport mechanism for transporting a ladder having a first side rail and a second side rail, where the first and the second side rails each have an inner surface and an outer surface and where the first and the second side rail inner surfaces are connected by a plurality of rungs between and having an upper surface and under surface of each rung with side rails attached to each under surface of each rung with a first crevice and a second crevice formed from the intersection of a first side rail and the underside of the rung and the intersection of a second side rail of the rung and the underside of the rung.

The ladder transport mechanism has a thin walled tubular mechanism with a wall thickness at least 0.125 inches thick which has a longitudinal axis where the tubular mechanism encloses a tubular space at least 2.5 inches in diameter but no more than 3.0 inches in diameter along a continuous longitudinal axis extending about 10 inches.

The channel U-beam extends along and is attached to the external diameter of the tubular mechanism where the channel U-beam opens facing the tubular mechanism and is attached there.

The transport mechanism has a first side rail of the channel U-beam that forms an acute angle between the first side rail and the flat top of the channel U-beam and where a second side rail of the channel U-beam forms an obtuse angle between the second side rail and the flat top of the channel U-beam so that a first edge is formed by the intersection of the first side rail and the flat top of the channel U-beam intersects the first crevice of the under rung.

There exists a second edge formed by the intersection of the second side rail and the flat top of the channel U-beam intersects the second crevice of the under rung and a channel opens under the channel U-beam where a first channel edge meets a first channel U-beam edge and where a second channel edge meets a second channel U-beam edge.

The invention claimed is:

1. A ladder transport mechanism for transporting a ladder having a first side rail and a second side rail, wherein the first and the second side rails each have an inner surface and an outer surface and wherein the first and the second side rails inner surfaces are connected by a plurality of rungs therebetween and having an upper surface and under surface of each rung with the side rails attached to each under surface of each rung with a first crevice and a second crevice formed from the intersection of the first side rail and the underside of the rung and the intersection of the second side rail and the underside of the rung, the mechanism comprising:

a thin walled tubular mechanism with a wall thickness at least 0.125 inches thick having a continuous longitudinal axis;

wherein the tubular mechanism encloses a tubular space at least 2.5 inches in diameter but no more than 3.0 inches in diameter along the continuous longitudinal axis extending from 3.0 inches to no more than 10 inches;

a channel U-beam extending along and attached to an external diameter of the tubular mechanism;

wherein the channel U-beam opens facing the tubular mechanism and is attached thereto;

wherein a first side rail of the channel forms an acute angle between the first side rail and a flat top of the channel U-beam;

wherein a second side rail of the channel forms an obtuse angle between the second side rail and the flat top of the channel U-beam;

a first edge formed by the intersection of the first side rail and the flat top of the channel U-beam configured to intersect the first crevice of the under rung; and, a second edge formed by the intersection of the second side rail and the flat top of the channel U-beam configured to intersect the second crevice of the under rung.

2. A ladder transport mechanism for transporting a ladder having a first side rail and a second side rail, wherein the first and the second side rails each have an inner surface and an outer surface and wherein the first and the second side rails inner surfaces are connected by a plurality of rungs therebetween and having an upper surface and under surface of each rung with the side rails attached to each under surface of each rung with a first crevice and a second crevice formed from the intersection of the first side rail and the underside of the rung and the intersection of the second side rail and the underside of the rung, the mechanism comprising:

a thin walled tubular mechanism with a wall thickness at least 0.125 inches thick having a continuous longitudinal axis;

wherein the tubular mechanism encloses a tubular space at least 2.5 inches in diameter but no more than 3.0 inches in diameter along the continuous longitudinal axis extending about 10 inches;

a channel U-beam extending along and attached to an external diameter of the tubular mechanism;

wherein the channel U-beam opens facing the tubular mechanism and is attached thereto;

wherein a first side rail of the channel U-beam forms an acute angle between the first side rail and a flat top of the channel U-beam;

wherein a second side rail of the channel U-beam forms an obtuse angle between the second side rail and the flat top of the channel U-beam;

a first edge formed by the intersection of the first side rail and the flat top of the channel U-beam configured to intersect the first crevice of the under rung;

a second edge formed by the intersection of the second side rail and the flat top of the channel U-beam configured to intersect the second crevice of the under rung;

a channel opening under the channel U-beam where a first channel edge meets a first channel U-beam edge and, a second channel edge meets a second channel U-beam edge.

3. The ladder transport mechanism as described in one of claim 1 or claim 2, wherein the mechanism further comprises: a speaker configured to be fit within the tubular space.

4. The ladder transport mechanism as described in one of claim 1 or claim 2, wherein the mechanism further comprises: a set of internally mounted lights located on the tubular mechanism.

* * * * *